US005490357A

United States Patent [19]

Lin

[11] Patent Number: 5,490,357

[45] Date of Patent: Feb. 13, 1996

[54] STRUCTURE ROOM DIVIDER HEIGHT EXTENSION

[75] Inventor: Ching-Hua Lin, Taipei, Taiwan

[73] Assignee: UB Office Systems Incorporation, Taipei, Taiwan

[21] Appl. No.: 269,805

[22] Filed: Jun. 30, 1994

[51] Int. Cl.[6] ..... E04B 2/74

[52] U.S. Cl. ..... 52/220.7; 52/239

[58] Field of Search ..... 52/592.6, 238.1, 52/239, 220.7

[56] References Cited

U.S. PATENT DOCUMENTS

| | | | |
|---|---|---|---|
| 4,631,881 | 12/1986 | Charman | 52/238.1 X |
| 5,117,599 | 6/1992 | Voss | 52/238.1 |
| 5,125,201 | 6/1992 | Pieters et al. | 52/238.1 |
| 5,394,668 | 3/1995 | Um | 52/592.6 X |

FOREIGN PATENT DOCUMENTS

| | | | |
|---|---|---|---|
| 2835952 | 3/1979 | Germany | 52/238.1 |

*Primary Examiner*—Carl D. Friedman
*Assistant Examiner*—Yvonne Horton-Richardson
*Attorney, Agent, or Firm*—Pro-Techtor International

[57] ABSTRACT

The invention relates to a room divider height extension, specifically referring to a kind installed onto an existent lower room divider to increase the original height, with three inverted-U shaped support tabs welded along the bottom edge. Furthermore, there are semicircular tabs protruding from the lower edge of the left and right aforesaid support tabs that are inserted into the U-shaped slots along the upper edge of the existent room divider, and when the room divider height extension and the existent room divider are firmly assembled together, a square tunnel is formed for the placement of electric power lines, telephone lines, computer cables within the improved structure, all of which comprise the primary innovations of the invention herein.

1 Claim, 5 Drawing Sheets

STRUCTURE ROOM DIVIDER HEIGHT EXTENSION

BACKGROUND OF THE INVENTION

The invention here consists of an improved structure room divider height extension, specifically referring to a kind installed onto an existent lower room divider to increase the original height, with three inverted-U shaped support tabs welded along the bottom edge. Furthermore, there are semicircular tabs protruding from the lower edge of the left and right aforesaid support tabs of the aforesaid room divider height extension that are inserted into the U-shaped slots along the upper edge of the existent room divider, and when the room divider height extension and the existent room divider are firmly assembled together, a square tunnel is formed for the placement of electric power lines, telephone lines, computer cables within the improved structure.

Conventional office-use room dividers are available in various specifications, with heights including 1000H, 1200H, 1350H, 1500H and 1800H. However, each different height has a varying range of intervals. For example, in an open office environment, a room divider system 1,000 mm in height can be installed as interior partitioning without difficulty; a room divider system 1,200 mm in height offers more privacy and better concentration efficiency; a room divider system 1,500 mm in height offers a separated and focused working environment; and a room divider system 1,800 mm in height offers an independent working environment. Therefore, different height room dividers provide for various kinds of working environment. However, after a planned room divider system is constructed in most business offices, it is impossible to raise or lower the height and modifying the height of the existent room divider would require total reconstruction and an extensive renovation project resulting is great waste of materials and major inconvenience; in the active height adjustment mechanism of a conventional structure room divider extension, as indicated in FIG. 1, the room divider height extension (10) is installed on the existent room divider (12) and on each of the two lower sides of the room divider extension (10) is a round insertion pin (11) and the insertion pins (11) are inserted into the insertion pin holes (14) at both ends of the U-shaped slot (13) to attain the objective of a firmly installable room divider height extension. However, although a tunnel for the hidden installation of electric power lines, telephone lines and computer cable circuit system is designed into the conventional room divider height extension structure, the originally installed line/cabling channel may be obstructed by the insertion of the room divider height extension (10) pins (11) and forcing the assembly of the room divider extension (10) will crush the originally installed line/cabling and adversely affect the operation of the circuit system.

As a result, the improvement of the aforementioned room divider height extension design problems in overall modem office planning as well as striving for a more ideal and practical design have become major objectives. The invention herein has overcome the problems of conventional room divider height extensions through extensive research in a spirit of continuous effort involving three prototypes and related improvements, culminating in the research and development of a kind of improved structure room divider height extension that genuinely solves the shortcomings of the conventional product.

Therefore, the primary objective of the invention herein is to provide a kind of improved structure room divider height extension, the utilization of which economizes on the materials and labor required to modify an existent room divider and thereby increases the practical value of the improved structure room divider extension invention herein.

To enable the examination committee to acquire a full understanding of the structure and content of the invention herein, the following brief descriptions of the drawings and detailed description of the invention herein are attached to illustrate the advantages and innovativeness. However, the following descriptions of the preferred embodiment shall not be construed as limitations outside the claims of the invention herein, including related modifications such as changes in the number and the nature of the components, but shall be remain within the rightful claims of the invention herein.

BRIEF DESCRIPTION OF THE DRAWINGS

FIG. 2-1 is an isometric structural drawing of the invention herein, with a portion of the structure in magnified view.

COMPONENTS OF THE DRAWINGS

| | |
|---|---|
| (10) Room divider height extension | (11) Insertion pin |
| (12) Existent room divider | (13) Slot |
| (14) Insertion pin hole | (15) Electric power line |
| (20) Room divider height extension | (21) Support tabs |
| (211) Semicircular tabs | (212) Line/cable tunnel |
| (22) Existent room divider | (23) Slot |
| (221) Square holes | (24) Support tabs |
| (25) Electric power line | |

DETAILED DESCRIPTION OF THE INVENTION

Figure 1:
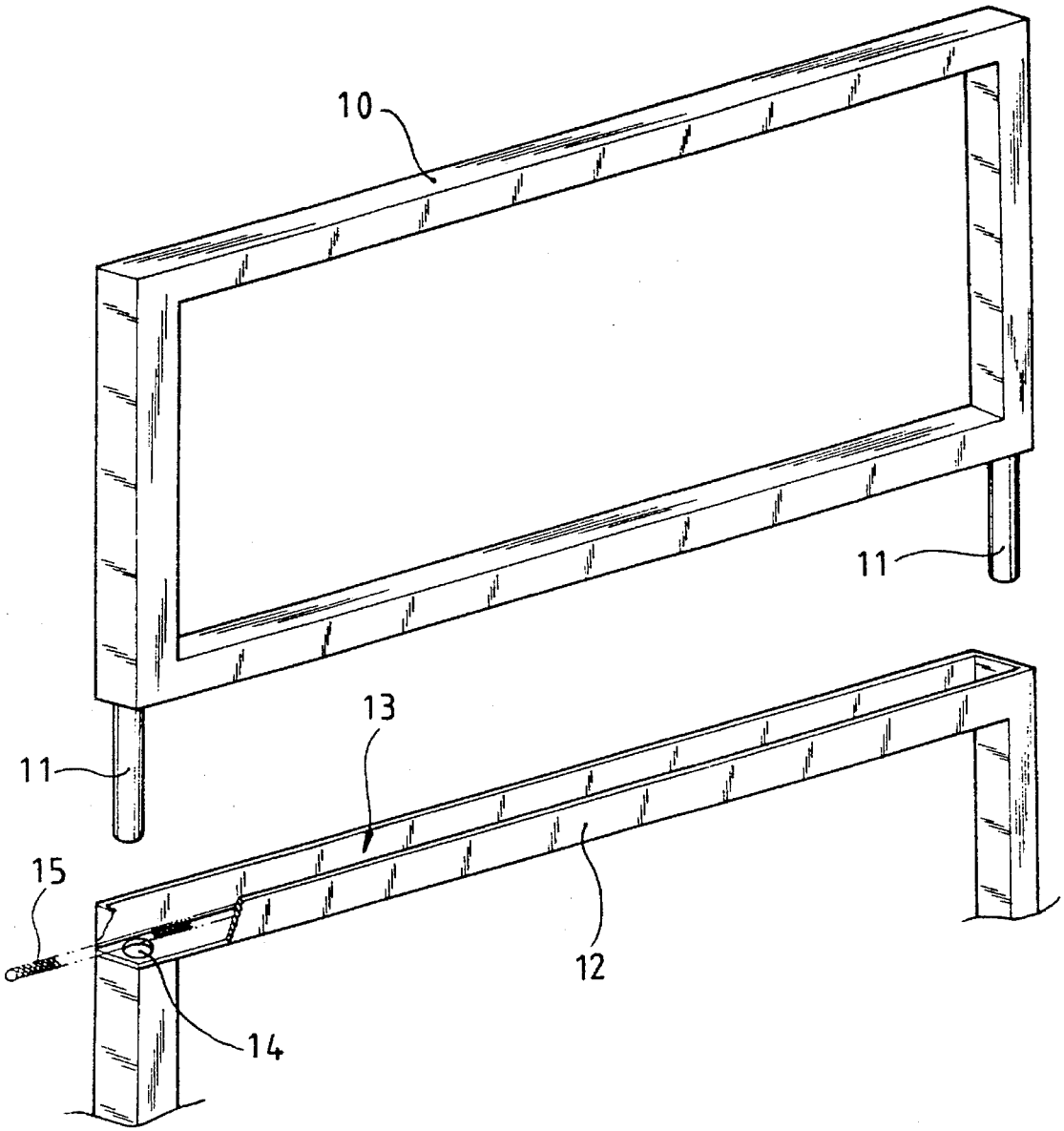
FIG. 1 (PRIOR ART)
FIG. 1 is an isometric drawing of a conventional product.
Figure 2:
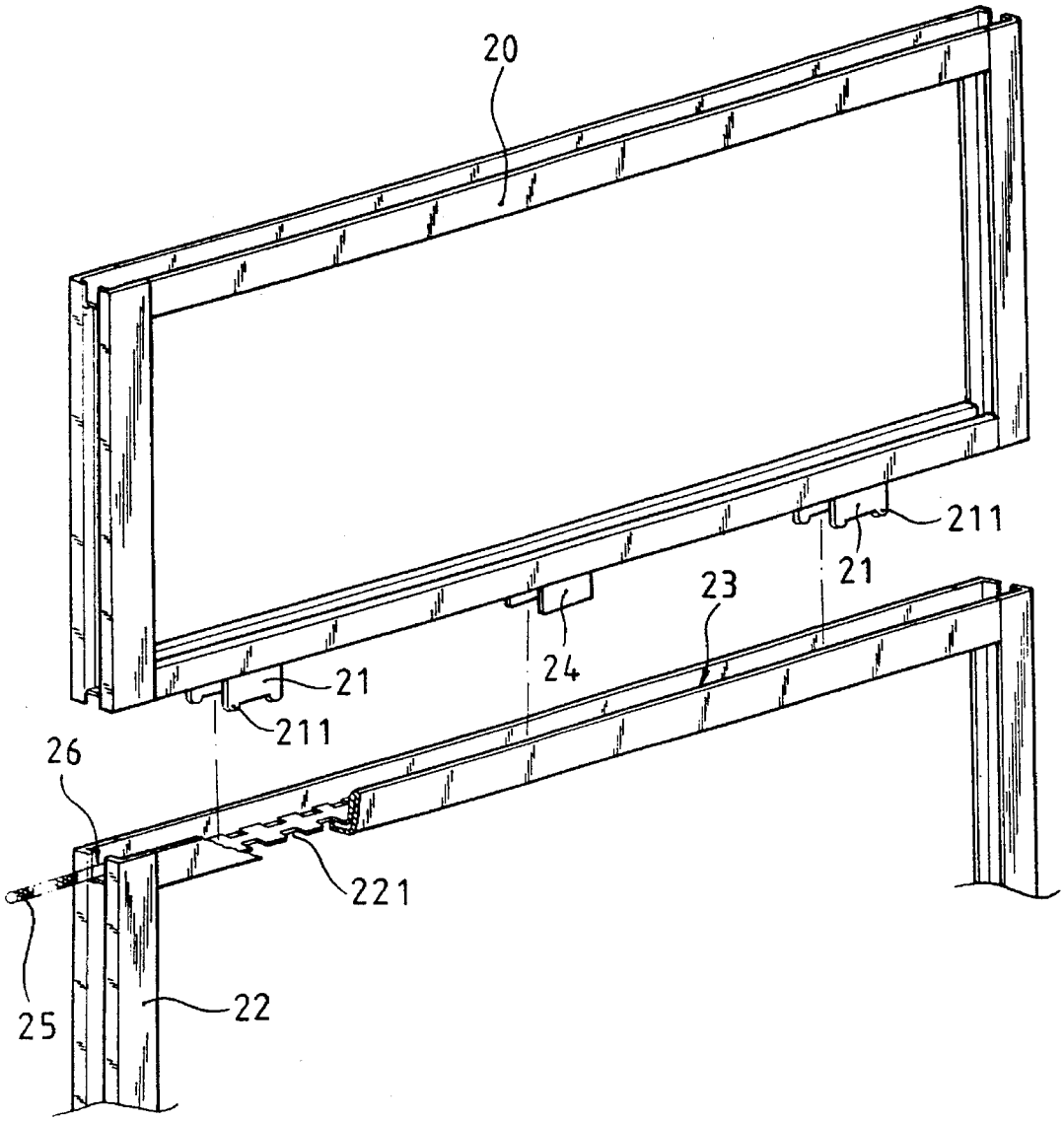
FIG. 2 is an isometric structural drawing of the invention herein.
Figure 2A:
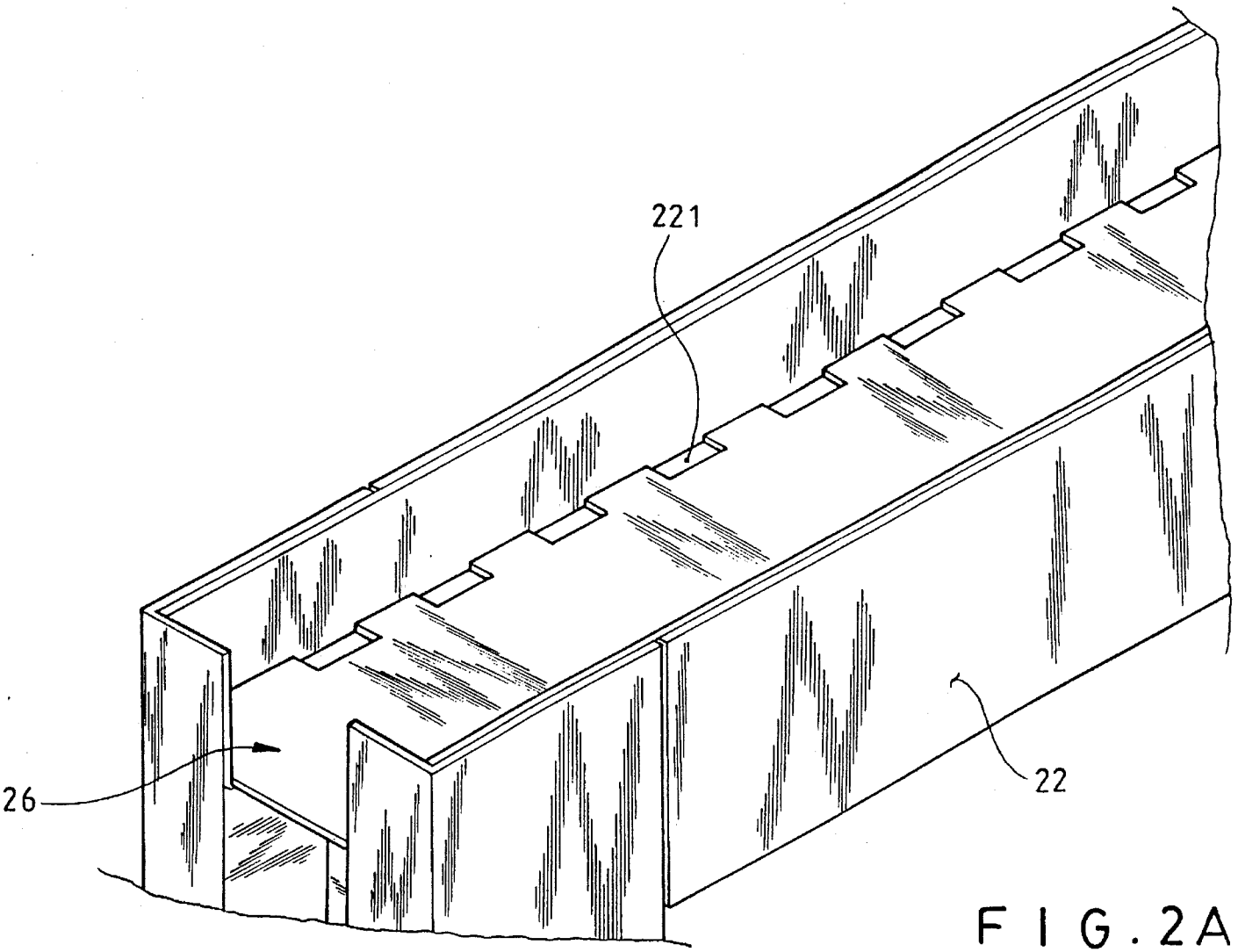

First, as indicated in FIG. 2, the invention herein is comprised of a room divider height extension (20) that has three inverted-U shaped support tabs (21), (21) and (24) welded to the lower edge, and protruding from the lower edges of the support tabs (21) are four semicircular tabs (211) that are inserted into the square holes (221) inside the U-shaped slots (23) of the existent room divider. Furthermore, the support tabs (21) and the slots (23) when inserted together form a square line/cable tunnel (212), wherein the aforesaid tunnel can accommodate the installation of electric power line(s) (25) (or telephone lines, computer cables and so on) through openings (26) on two sides of the tunnel (212). Each room divider height extension (20) has three support tabs (21), (21) and (24). Making it is easy to maintain an even contact between the matching surfaces after the room divider extension (20) and the existent room divider (22) are assembled together as opposed to the results depicted in FIG. 1 of the conventional product, wherein the room divider extension (10) is often slanted forward or rearward in appearance and function due to the method of assembly.

Figure 3:
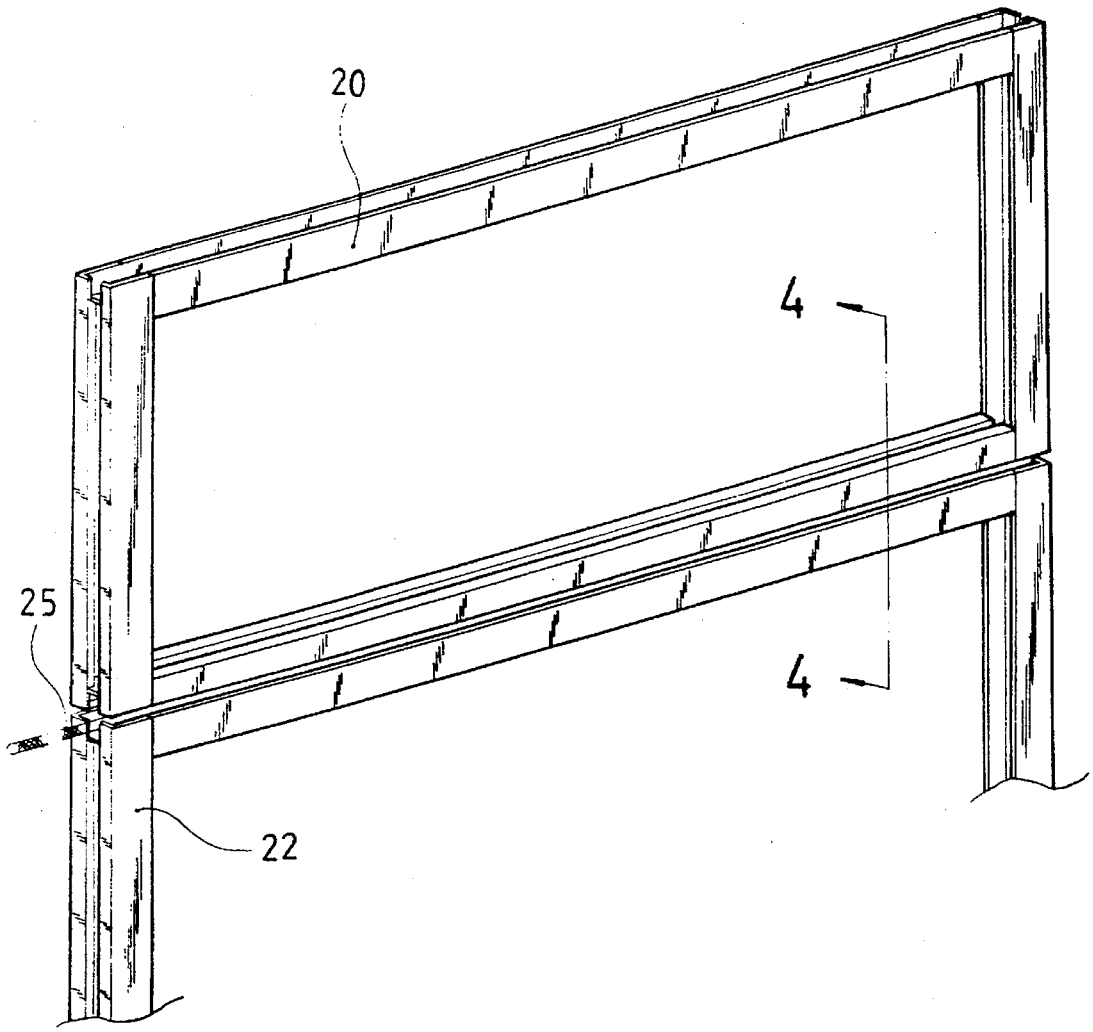
FIG. 3 is an isometric structural drawing that depicts the assembled invention herein.
Figure 4:
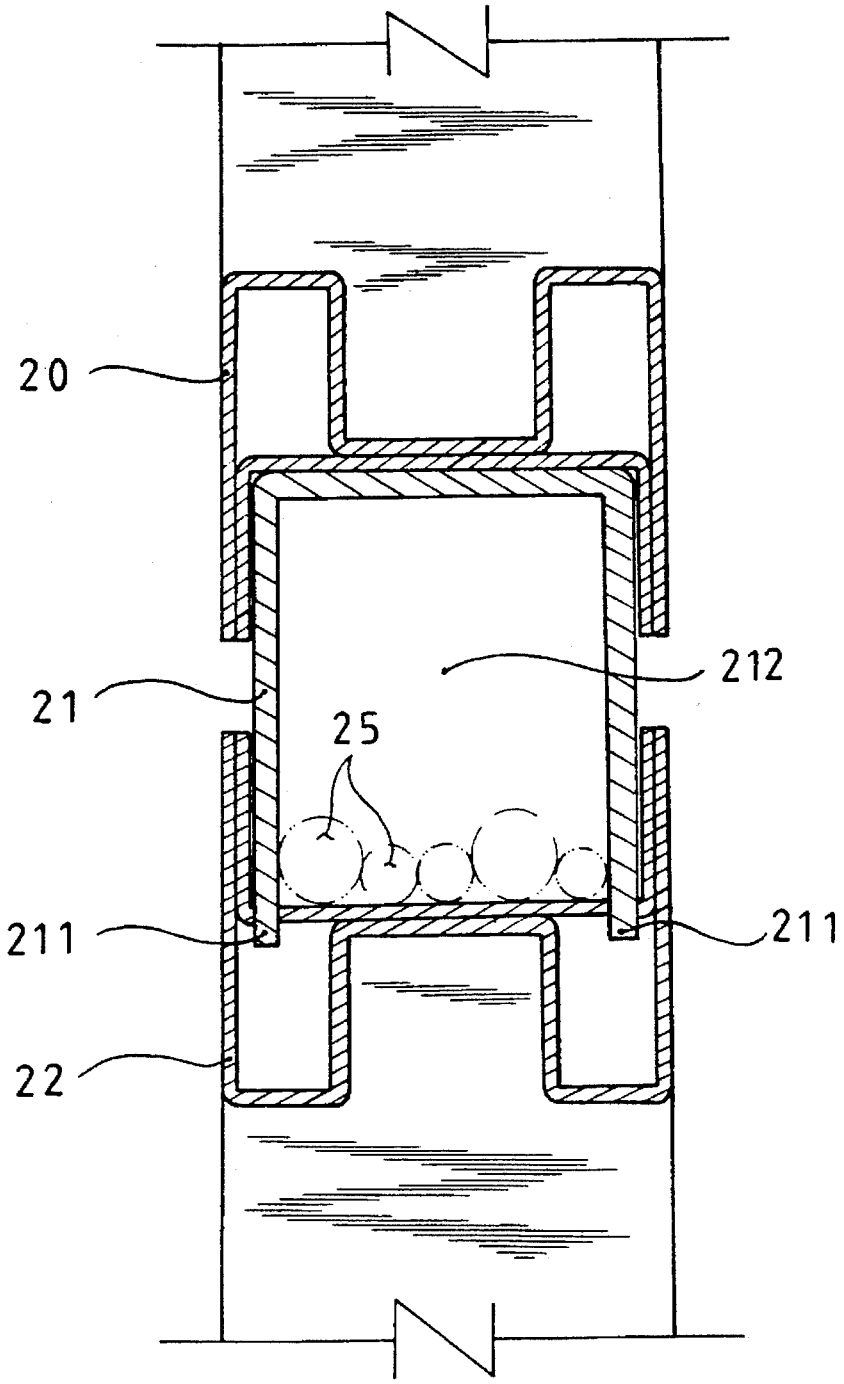
FIG. 4 is an isometric structural drawing of the invention herein illustrating the insertion of sections A—A. ("A—A" refers to the component name.)

As indicated in FIG. 3 and FIG. 4, the two sides of the support tabs (21) of the invention herein are slanted inwards at slight angle to facilitate height adjustment during the installation process. As indicated in the drawings, the line/cable tunnel (212) formed through the assembly of the support tabs (21) to the existent room divider (22) can accommodate the installation of line and cable circuit systems.

Based on the foregoing description, the invention herein constitutes an improvement of the conventional product and, in terms of application, is the first innovation of its kind within the same product category. The invention herein has more enhanced practical functions and unquestionable "originality"; thereby attaining all the objectives claimed by the invention herein and complying with the conditions of "practicality" required for patent rights and in accordance thereof, the application for patent rights based on the "originality" of the invention herein is hereby submitted for examination and the granting of the respective patent rights.

What is claimed is:

1. A room divider height extension that includes:

An original room divider structurally consisting of an oblong partition that has a U-shaped slot along the upper edge and on two sides of the aforesaid slot are openings for the insertion of electric power lines, furthermore, there are square holes arrayed at equal intervals on the lower portion of the aforementioned slot;

A room divider height extension structurally consisting of an oblong panel that has three inverted-U shaped support tabs welded to the bottom edge and the two sides of the aforesaid support tabs are slanted inwards at a slight angle; furthermore, the width of the aforesaid support tabs is identical to the inner lateral width of the aforementioned U-shaped slot on the aforementioned original room divider to facilitate the insertion of the aforesaid support tabs into the aforesaid U-shaped slot;

the inverted-U shaped support tabs of the aforementioned room divider height extension, further comprising four semicircular tabs protruding from the left and the right lower edges of the aforesaid support tabs, wherein the aforesaid four semicircular tabs are utilized for insertion into the aforementioned square holes arrayed at equal intervals on the lower portion of the aforementioned U-shaped slot along the upper edge of the aforementioned original room divider and to tightly assemble the aforesaid room divider extension to the aforesaid original room divider, while the insertion together of the aforesaid support tabs and the aforesaid U-shape slot forms a line/cable tunnel that accommodates the hidden installation of electric power lines as well as facilitates simple height adjustment during the installation process.

* * * * *